US007275535B1

(12) United States Patent
Brockman

(10) Patent No.: US 7,275,535 B1
(45) Date of Patent: Oct. 2, 2007

(54) RESPIRATION HOOD USEFUL IN BIOLOGICAL, RADIOLOGICAL AND CHEMICAL EMERGENCIES

(76) Inventor: Robert Brockman, 2928 Elmwood Ave., Bakersfield, CA (US) 93305

( * ) Notice: Subject to any disclaimer, the term of this patent is extended or adjusted under 35 U.S.C. 154(b) by 309 days.

(21) Appl. No.: 10/602,039

(22) Filed: Jun. 23, 2003

(51) Int. Cl.
*B65B 1/04* (2006.01)

(52) U.S. Cl. ..... 128/201.25; 2/171.3

(58) Field of Classification Search ..... 128/201.22, 128/201.23, 201.24, 201.25, 201.29, 205.25, 128/205.27, 205.29, 206.12, 206.17, 206.21; 2/171.3, 410, 5, 6.6
See application file for complete search history.

(56) References Cited

U.S. PATENT DOCUMENTS 4,793,343 A * 12/1988 Cummins et al. ..... 128/204.17
5,054,480 A * 10/1991 Bare et al. ..... 128/201.25
5,125,402 A * 6/1992 Greenough ..... 128/201.25
5,887,281 A * 3/1999 Green et al. ..... 2/171.3
6,388,813 B1 * 5/2002 Wilson et al. ..... 359/630
6,481,019 B2 * 11/2002 Diaz et al. ..... 2/171.3
6,968,842 B1 * 11/2005 Truschel et al. ..... 128/204.18
2003/0101505 A1 * 6/2003 Paris et al. ..... 2/171.3
2003/0182710 A1 * 10/2003 Klotz et al. ..... 2/171.3

* cited by examiner

*Primary Examiner*—Steven O. Douglas
(74) *Attorney, Agent, or Firm*—I. Michael Bak-Boychuk

(57) ABSTRACT

A respiration hood assembly is effected from a thin-walled headpiece nested within the periphery of a mating exterior housing that includes a filtered aperture. The nested engagement between the headpiece and the housing is also useful in capturing one edge of a plastic membrane skirt that is thus suspended to drape over the person wearing the headpiece. A battery powered electric fan is deployed within the housing to draw ambient air through the vent aperture into the space shrouded by the skirt. The nested headpiece arrangement is useful in retaining other fibrous towels or tissue to extend the usefulness of the assembly and a parallel connection is provided to a motor vehicle battery to extend the period of electrical excitation.

16 Claims, 5 Drawing Sheets

RESPIRATION HOOD USEFUL IN BIOLOGICAL, RADIOLOGICAL AND CHEMICAL EMERGENCIES

BACKGROUND OF THE INVENTION

1. Field of the Invention

The present invention relates to breathing devices, and more particularly to respiration hoods useful in protecting a person during biological or chemical emergencies.

2. Description of the Prior Art

Recent world events have drawn public concern, attention and focus to the persistent problem of terrorism. At the core is the paradox that the same information technology advances that have facilitated democratic governance have also found use in manipulating and then arming those that may disagree with the majority. Short term distortions in this information stream, by misinformation, disinformation and other manipulations, are now used successfully to motivate these dissident drives. Simply, the slow and deliberate processes of democratic consensus operate in the time domain of a fully developed information stream that is much slower than the psychological manipulation time constant of a single person, or a small group, of those on the fringe. To conceal the manipulator these manipulated fringes are then selectively directed to the same information technology for all sorts of chemical, biological, radiological, or even nuclear devices of terror. The majority then is either intuitively aware, or has been brought to awareness by recent events, of the pervasive existence of these manipulators together with the plentiful supply of the manipulated malcontents and the horrible prospects of this fertile combination now distort our ability to engage in clear thought.

These distorted perceptions stem from our current inability to fend for ourselves, to protect those that depend on each one of us, and some measure of individually accessible protection is necessary in order to carry on any rational democratic discourse. Against this backdrop being helpless is fundamentally antisocial, if not undemocratic.

Characteristically those who are manipulated to commit terror must lack the organization, skill repertoire and other attributes of a well organized social group—otherwise they reveal the social structure of the manipulator, who is then exposed to vigorous reprisal. For these reasons most of the terror devices are inherently less than well developed, being significant only for the fear and insecurity they create and not for the degree of their technical efficacy or development. The defensive devices to these items of terror similarly do not need to be at the zenith of perfection, needing only the basic attributes of protection but in a form that can be widely and inexpensively made and acquired and also easily used and thereafter disposed. Simply, the devices that allow us to fend for our selves must be fully democratic so that we can remain democratic.

Within the group of easily produced devices of terror it is those that rely on air borne delivery that are best defeated by self help. Thus air borne chemical agents, biological agents or even radiological agents are those that present the most immediate risk, being easily absorbed by skin contact or in the course of respiration. In the past various gas masks have been devised which in one way or another filter the breathing air exemplified by the various methods of their attachment or function in U.S. Pat. Nos. 5,630,412 to Dubruille; 6,470,887 to Martinez; 6,070,580 to McDonald, et al.; 5,771,886 to Maire, et al.; and 5,623,923 to Bertheau, et al. Alternatively, various respiration hoods in the prior art are exemplified in U.S. Pat. Nos. 6,102,034 to Buhlmann; 6,134,716 to Richardson, 6,371,116 to Resnick; 6,463,589 to Wang; 5,526,804 to Ottestad; and 5,452,712 to Richardson. While each of the foregoing are suitable for the purposes intended, none posses the simplicity and use convenience that is required in a terror emergency, and particularly the convenience that allows quick personal use thereof and quick deployment to protect an infant or a child.

Those skilled in the art will appreciate that a terror emergency event is usually recognized and announced way before its full scope and effectiveness are assessed. Thus there is both a circumstance where the protective response needs to be quick and also one that is basically uninformed about the event that is responded to. For example an alarm condition may be evoked by suspicions of a bacteriological (e.g., anthrax) event, a chemical (e.g., nerve gas) event, or a radiologic emission into the local atmosphere, each of which dictating a similar immediate response amongst the potentially exposed public regardless of the exact nature of the event. Universally these atmospherically carried hazards also define the primary exposure path as one associated with skin contact and respiration and it has long been recognized that filtering the aspirated air together with some passive shielding of the exposed skin surfaces provides the most practical level of protection. Thus the common attributes of the terror mechanism define the response and a simple, inexpensive and therefore discardable barrier that filters the respiration intake is extensively desired and it is one such barrier that is disclosed herein.

SUMMARY OF THE INVENTION

Accordingly, it is the general purpose and object of the present invention to provide a respiration hood provided with a self contained and filtered air transport mechanism for transmitting air into the interior thereof.

Other objects of the invention are to provide a respiration hood into which ambient air is drawn across a filtering medium and through an electrically charged field.

Further objects of the invention are to provide a respiration shield which includes conveniently discardable filtering elements.

Yet additional objects of the present invention are to provide a respiration shield that is easily worn and inexpensive in fabrication.

Briefly, these and other objects are accomplished within the present invention by providing a generally oval, dished shell conformed to include a head fitting piece on the interior thereof to receive the head of an adult person and including a forward portion extending above and forwards of the person's face. A flexible skirt is suspended from the periphery of the shell to extend over and drape the shoulders and chest of the user with that portion of the skirt extending over the user's face being spaced therefrom by the forward portion. The exterior surface of the shell is then also useful to support a housing enclosing an open brush electric motor driving a fan mounted in an aperture formed in the forward portion, the housing further including a removable filter behind a set of louvered openings formed in the top surface of the housing with the remaining housing volume storing both a battery and a parallel set of exterior terminals to power the motor.

Preferably the upper shell, the housing thereon and the skirt attached to its periphery are all formed of plastic materials characterized by a generally smooth, impervious exterior surface. Thus any air borne particulate matter settling on these exterior surfaces is prone to be easily shed, blown off or even washed off. To further enhance these shedding functions the louvered intake in the housing is located at its highest point, with the louvers shaped as saddle surfaces having few horizontal planes for accumulating dust and particulate matter. The polymeric material structure of the inventive hood assembly, moreover, cooperates synergistically with the open brush configuration of the electric motor which, in the course of its use, sheds a continuous ring of arcing and ionization at the brush to commutator interface, thus providing a source of an electrical charge field that is then useful to polarize the adjacent polymeric materials. This, of course, will aid in the charged retention of non-conducting particulate matter that may be collected in the filter while still accommodating the shedding of conductive metal particulates which, in the event of a radiological incident, are more prone to be radioactive. These electrical charge aspects can then be further utilized to advantage by the positional geometry of the motor within the housing immediately behind and adjacent the intake filter, thereby imposing the highest charge effects onto an element that is periodically replaced.

Those skilled in the art will appreciate that the same configuration of the hood that may be rendered useful to protect an adult is also useful, with simple attachment expedients, to shield the principal respiration paths of a child or even an infant. For example, the head piece may be provided with downwardly depending clips and straps for attachment thereof the a child's car seat, crib or even the child's clothing and the peripheral edge hoop of the skirt may be controlled in its free dimension by various snaps, thus rendering it adaptable to the smaller dimensions of a child or the seat or crib containing the child. The skirt material, moreover, may comprise a transparent membrane to facilitate convenient visual inspection of the person enclosed and further visibility enhancements may be effected by a layered, peelable panel in the line of vision of the wearer. In this manner a widely adaptable positive pressure enclosure is formed which effectively directs all air intake through a filter assembly.

DESCRIPTION OF THE PREFERRED EMBODIMENT

Figure 1:
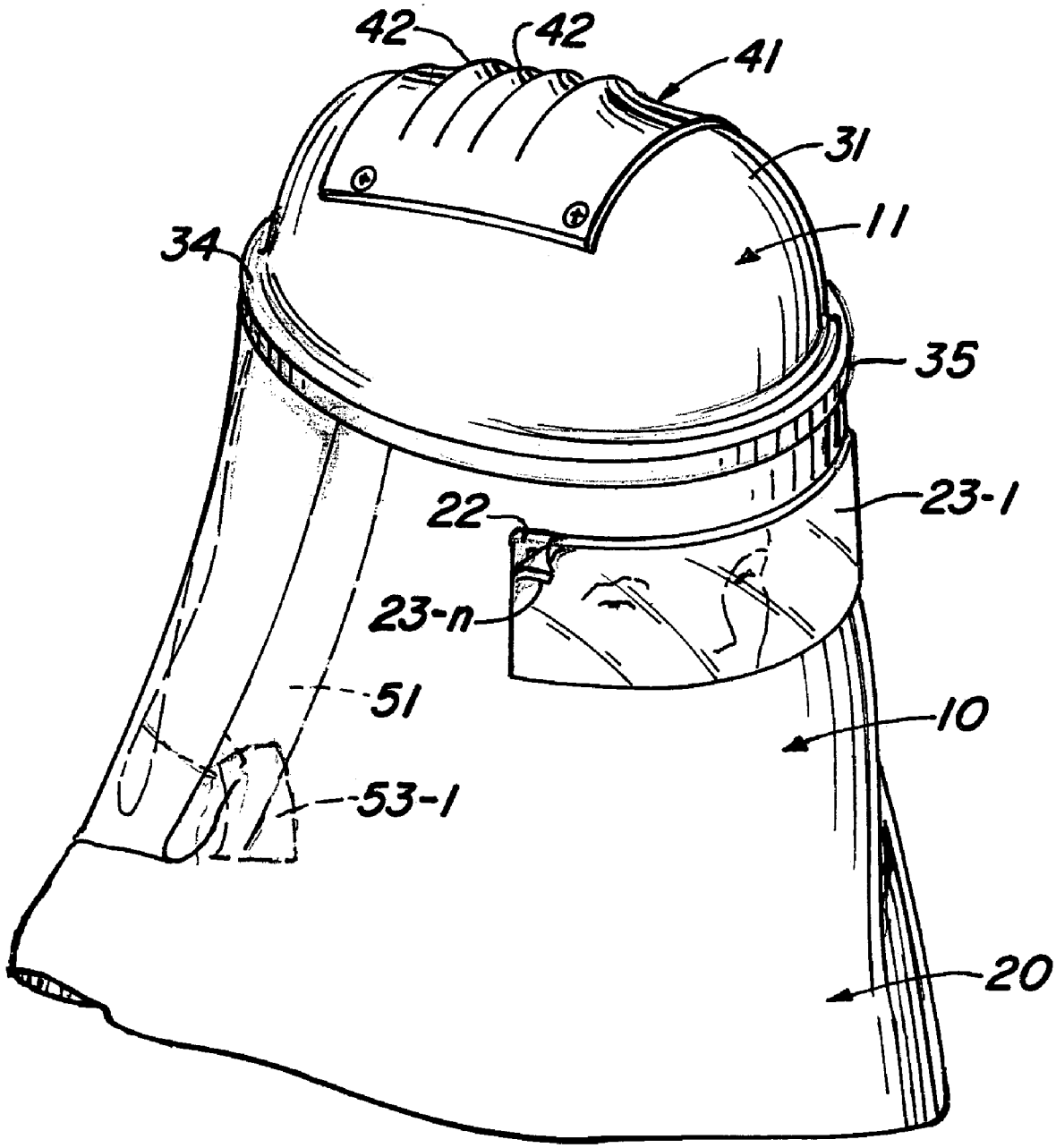
FIG. 1 is a perspective illustration of the inventive respiration hood in its deployed configuration on the person of a user.
Figure 2:
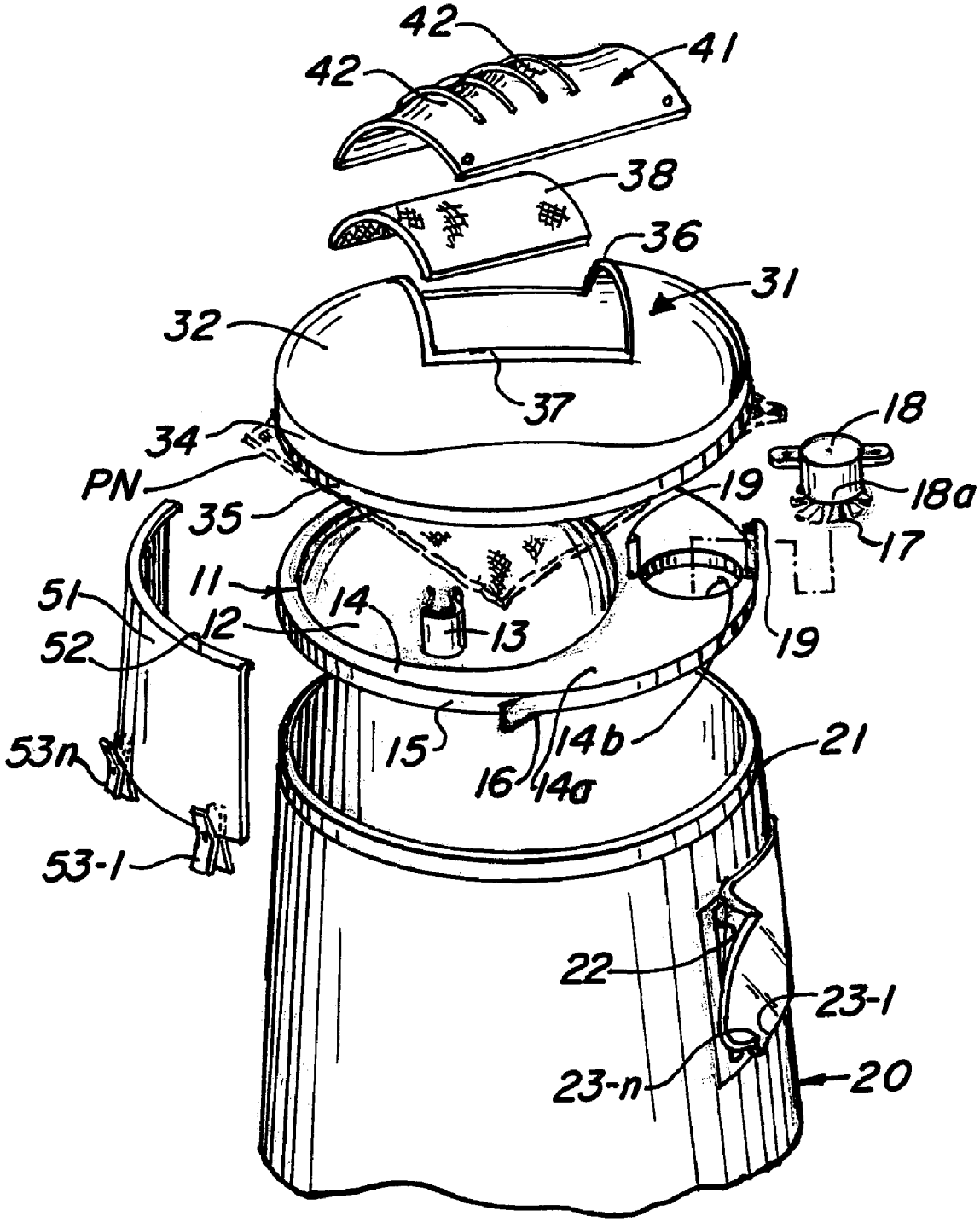
FIG. 2 is yet another perspective illustration, separated by parts, of the inventive respiration hood assembly shown in FIG. 1.
Figure 3:
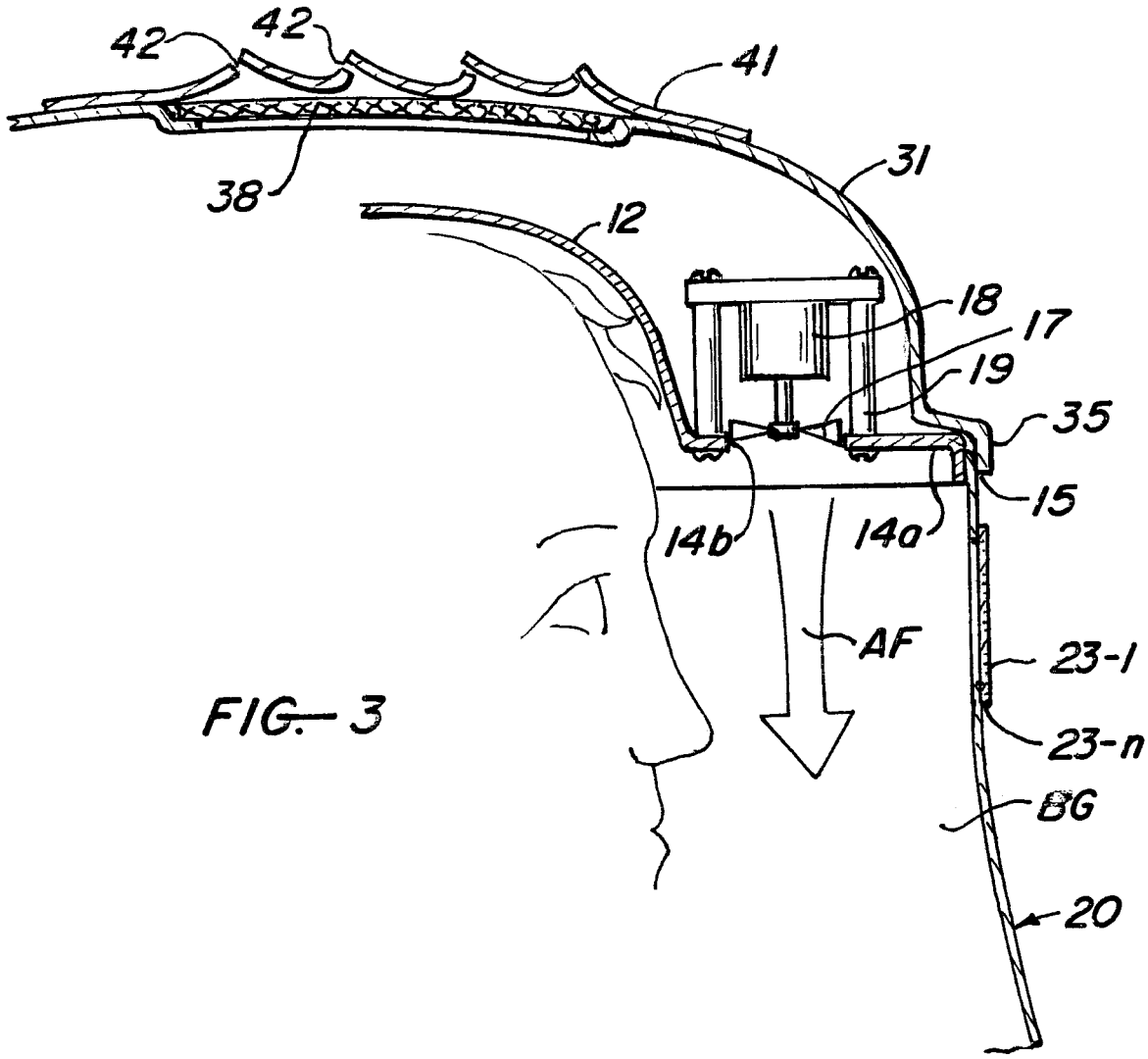
FIG. 3 is a sectional detail illustrating the filter receiving structure useful with the inventive respiration hood assembly disclosed herein.
Figure 5:
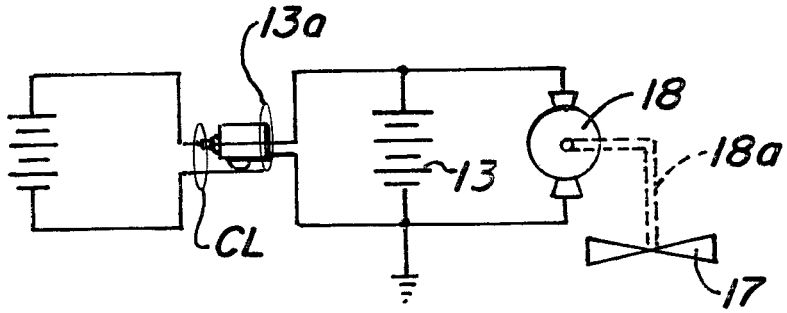
FIG. 5 is an electrical circuit diagram useful with the invention herein.
Figure 4:
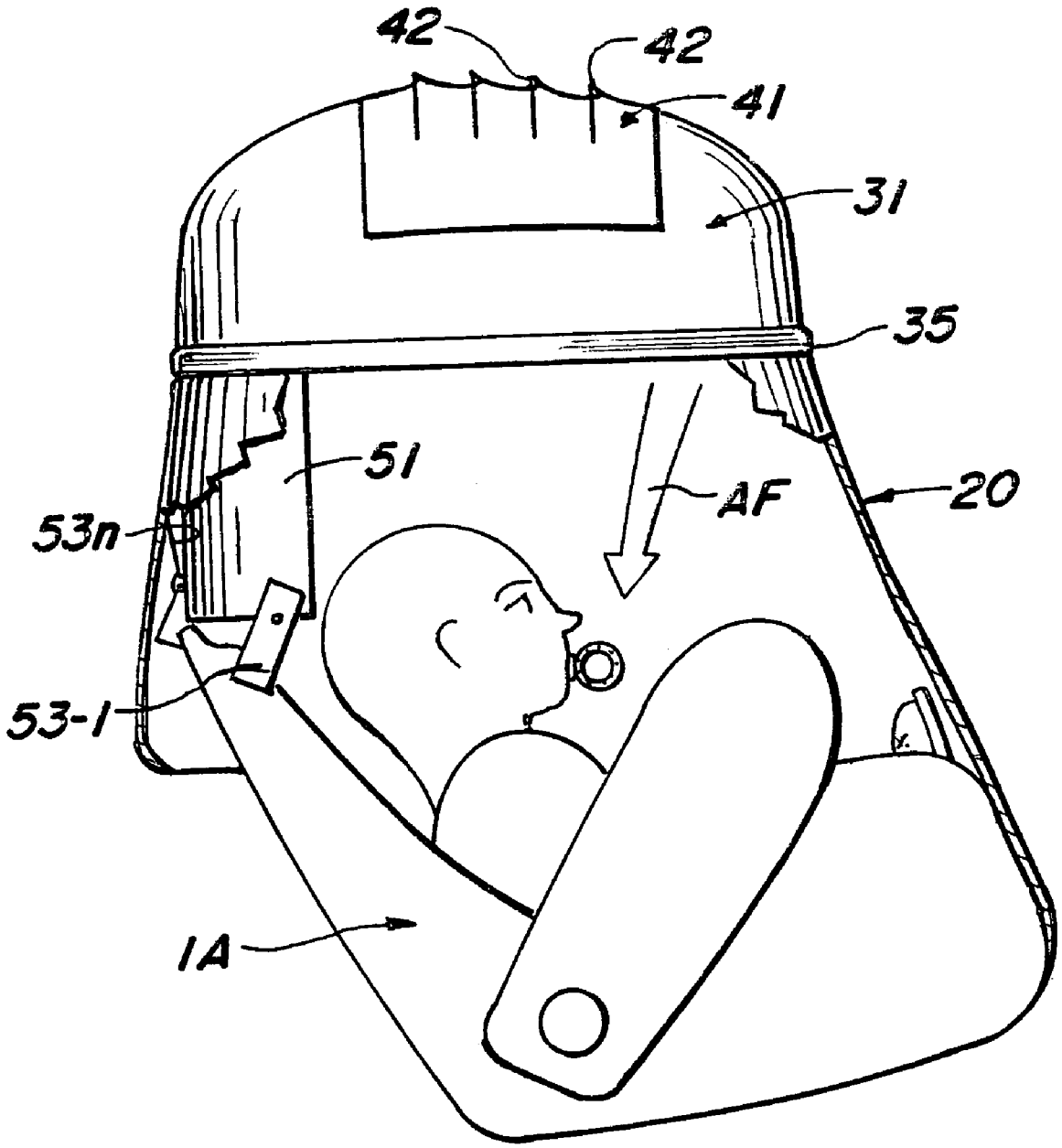
FIG. 4 is a further perspective illustration of the inventive hood assembly deployed to shield an infant contained in a baby carrier.
Figure 6:
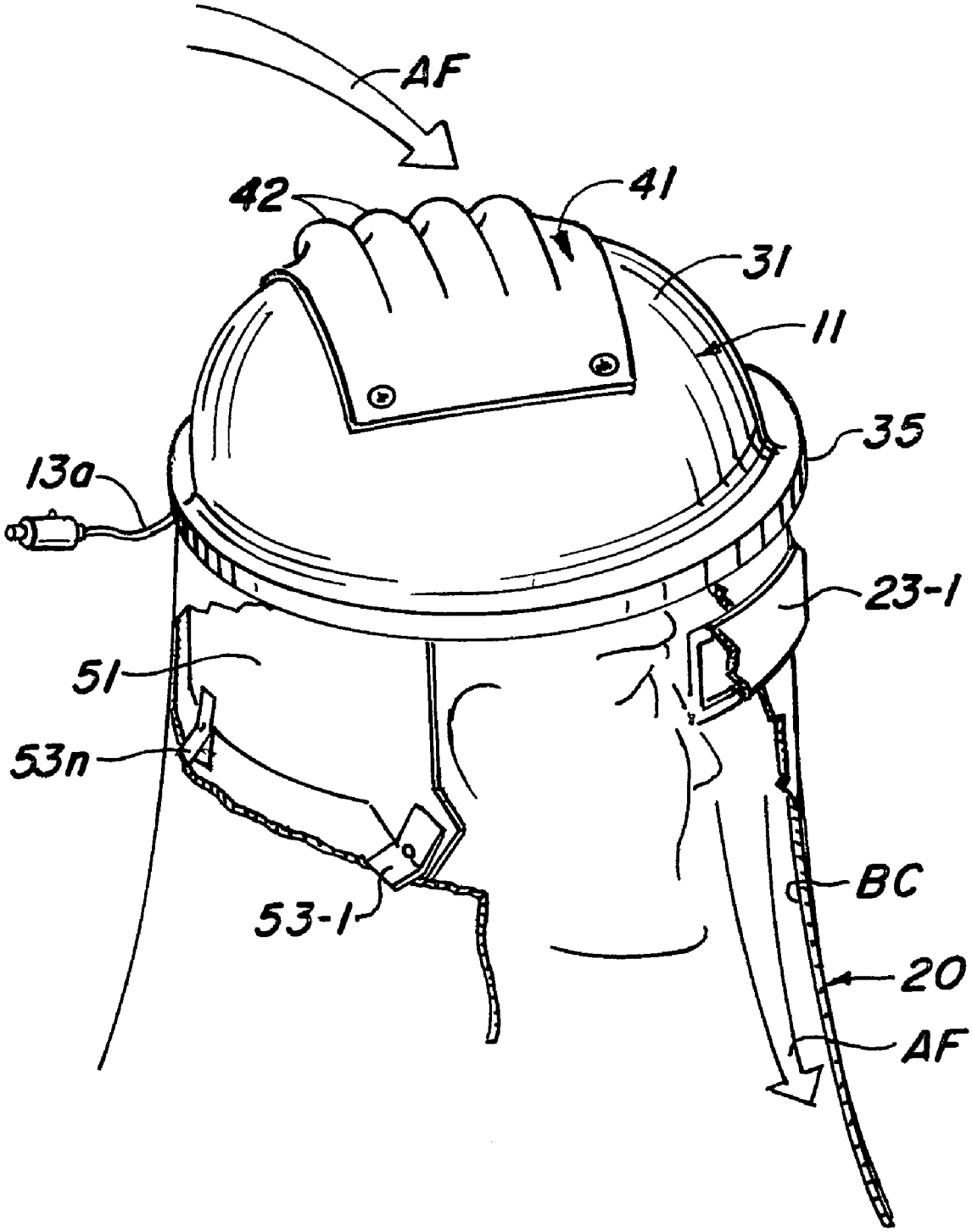
FIG. 6 is a diagrammatic illustration of the inventive hood assembly illustrating the air flow currents therethrough.

As shown in FIGS. 1 through 6 the inventive respiration hood assembly, generally designated by the numeral 10, includes a molded plastic cap-like head piece 11 defined by a hemispherical cap or bowl 12 conformed to the skull dimensions of an adult person surrounded about the periphery of its opening by a generally circular brim 14 that extends eccentrically therefrom to deploy a forward portion 14*a* overhanging the person's face. The peripheral edge of brim 14 is rolled over to form a downwardly directed edge 15 supporting on its exterior an adhesive strip 16 to which the interior edge surface 21 of a flexible plastic membrane skirt 20 is adhered. In this form the head piece 11 once positioned on the head of a user deploys skirt 20 adhered to the peripheral edge 15 of brim 14 to drape over the back of the user's head, his or her shoulders and in spaced relationship in front of the user's face to then drape his or her chest, thereby providing a shrouded breathing space BC in front of the user's mouth and nose. This breathing cavity BC is ventilated at positive pressure by a circular fan 17 supported for rotation within a circular opening 14*b* formed through portion 14*a* and engaged to the output shaft 18*a* of an electric motor 18 fixed on posts or spacers 19 above the brim surface. The electric motor 18, in turn, is powered by a battery 13 deployed on the back exterior surface of bowl 12 connected in parallel with a power cord 13*a* terminated for contact within a conventional cigarette lighter CL found in most motor vehicles. In this manner a continuous flow of air is delivered into the breathing cavity BC, drying and transporting away any moisture that may be emitted in the course of breathing to accommodate a clear view through a transparent viewing section 22 in skirt 20 which may be further protected against accumulation of obscuring dust on its exterior by a plurality of stacked, peelable films 23-1-23-*n* positioned thereon.

In this form the combination of the skirt 20 and the head piece 11 provide a shroud over the upper body of a person ventilated to positive pressure by the fan driven air flow AF right over the person's face. Any exit apertures that may be formed in the course of draping between the person and the lower skirt edge 25 will then be effectively emitting an outwardly directed stream of air, limiting all incidents of reverse ingestion of gas or air borne particulate matter. Thus only the air intake into fan 17 needs to be filtered and otherwise sanitized to protect the person that has donned this inventive shrouding structure, a filtering function contained in a mating dished exterior cover 31 provided again with a generally circular brim surface 34 surrounding a housing 32. Brim surface 34 includes its own downwardly directed peripheral edge 35 dimensioned for receiving engagement of edge strip 15 with the skirt 20 adhered thereto. The upper portion of housing 32 is then provided with a generally rectangular cut-out 36 bordered by a recessed ledge 37 for supporting the edges of a rectangular filter element 38 thereon. A removable louvered cover 41 fixes the filter in place, admitting air into the housing interior through a set of louvers 42 that are each formed to define a saddle surface for convenient shedding of any particulates that may be collected on the housing exterior.

Those skilled in the art will appreciate that any terror event will invariably entail a wide particle size distribution, some particles approaching the dimensions of an aerosol while others of a mass to surface ratio that effectively limits any persistent air borne propagation. Since both particle ranges pose a hazard when accumulated, substantial improvements are achieved if the larger, more massive particles are shed before being trapped in the filter. For this reason a smooth exterior finish is provided to the dished cover 31 and to also to the surface of louvered cover 41. Similarly, skirt 20 may be formed of a smooth plastic sheet material to promote shedding of any air borne particulates.

The collection and entrapment of the smaller, aerosol sized particulates, in turn, is improved by selecting an inexpensive open brush direct current motor configuration for motor 18 which in the course of its use produces an arcing ring. Motors of this type are generally less expensive as this commutator arcing is generally not desired because of the electrical noise that is usually created thereby. This arcing ionization, however, is used to advantage here by producing an electrostatic charge within the housing 32 which assists in the collection and entrapment of the small particles in filter 38.

The foregoing nested arrangement of brim 14 within brim 34 is also useful to trap and retain other supporting structures between the opposed brim surfaces, expanding the utility of the inventive assembly. For example, a flexible panel 51 provided with an edge bead 52 may be retained between the rear portions of the exterior brim surface 34 and the subjacent surface of brim 14 with bead 52 captured in their common folds. As result a curved form is imparted to panel 51 increasing its stiffness and utility as a supporting structure. A set of clips 53-1 through **53-*n* at the other peripheral edges of panel 51 can then be utilized to fasten the combined structure to the adjacent folds of any apparel AP worn by the user, thus positively securing the inventive respiration hood to the person of the user, or as illustrated in detail in FIG. 4, securing the hood assembly 10 over a crib or infant seat assembly IA. Notably, the capture of panel 51 can be selected by the user to be on the exterior of skirt 20**, or on the skirt interior (not shown), where the clips and fasteners thereby provided can be used for other manners of attachment such as those that may need to be effected to provide a respiration shield for a wounded or incapacitated person.

One will appreciate that any significant terror event will invariably result in substantial public confusion and disruption of the ordinary routes of replenishment and supply. Any protective device, and particularly a device that seeks to shield critical life functions like respiration, will therefore need to be quite robust and susceptible to refurbishing or renewal by ordinary and widely available means. Thus while a sufficient supply of filter elements 38 may be included with the hood assembly for an anticipated exposure duration, in a setting where these exposure periods are exceeded, coupled with the need to frequently discard and seal the filter elements because of the hazard of the matter collected therein, alternative filtering mechanisms may need to be substituted to extend the needed shielding duration. In these extended eventualities some filtering degradation may need to be accepted and items of ordinary use, like paper napkins PN, may then be inserted and captured between the inner head piece 11 and the exterior housing 31, either in conjunction with the filter elements 38 or as its replacement. Similarly, ordinary plastic sheeting, trash bags or other membranes may be substituted as the material forming skirt 20 in those instances where the original material is torn or otherwise damaged. In this manner the nested and interlocked arrangement between the brims of the interior head piece 11 and the exterior housing 31 offers wide levels of utility over extended periods of time and significant levels of degradation and it is exactly this kind of resilience that is needed in the exigent circumstances of a terror event.

Obviously, many modifications and variations can be effected without departing from the spirit of the invention instantly disclosed. It is therefore intended that the scope of the invention be determined solely by the claims appended hereto.

The invention claimed is:

1. A respiration hood assembly useful to draw air across a filter and convey same into a shrouded enclosure adjacent the face of a person, comprising:

a thin-walled headpiece defined by a bowl generally conformed to be worn on the head of said person and formed within a planar brim surface extending eccentrically from the periphery thereof, the larger portion of said brim surface being disposed to extend in cantilever above said face of said person and including an opening therein;

a thin-walled housing including a peripheral edge conformed for a nested releasably engaging receipt of the corresponding periphery of brim to form a cavity therebetween, said housing further including an aspiration vent communicating into said cavity;

filter means deployed in said housing adjacent said aspiration vent for filtering said ambient air passing into the interior thereof;

an electrically powered fan deployed within said cavity adjacent said opening in said brim for drawing ambient air across said filter means and through said cavity and for emitting said ambient air through said opening in said brim; and a plastic membrane skirt releasably captured between said periphery of said brim and peripheral edge of said housing to depend therefrom onto the body of said person.

2. Apparatus according to claim 1, further comprising:

a battery mounted in said cavity and connected for selective electrical excitation of said electrically powered fan.

3. Apparatus according to claim 2, further comprising:

electrical connection means deployed across said battery and conformed for electrical connection to an alternative source of electrical power.

4. Apparatus according to claim 1, wherein:

said aspiration vent includes a shouldered periphery conformed to engage the periphery of said filter means and a removable cover provided with louvered apertures therein.

5. Apparatus according to claim 4, further comprising:

a battery mounted in said cavity and connected for selective electrical excitation of said electrically powered fan and electrical connection means deployed across said battery conformed for electrical connection to an alternative source of electrical power.

6. Apparatus according to claim 5, wherein:

at least that portion of said skirt that is proximate to the face of said person is transparent.

7. A respiration hood useful to draw ambient air across a filter and to convey same into a shrouded enclosure adjacent the face of a person, comprising:

a thin-walled headpiece including a bowl generally conformed to be worn on the head of said person form within a planar brim surface extending eccentrically from the periphery thereof, said brim surface being disposed to extend in cantilever above said face of said person and including an opening therein;

a thin-walled housing conformed for releasable nested engaging retention of the corresponding periphery of said brim to form a cavity therebetween, said housing further including an aspiration vent communicating into said cavity;

an air filter deployed in said housing adjacent said aspiration vent;

an electrically powered fan deployed within said cavity adjacent said opening in said brim for drawing ambient air across said filter, through said cavity and thereafter emitting same through said opening in said brim; and a flexible skirt captured between said periphery of said brim and said housing to form said shrouded enclosure.

8. Apparatus according to claim 7, wherein:

said aspiration vent includes a shouldered periphery conformed to engage the periphery of said filter and a removable cover provided with louvered apertures therein.

9. Apparatus according to claim 8, further comprising:

a battery mounted in said cavity and connected for selective electrical excitation of said electrically powered fan and electrical connection means deployed across said battery conformed for electrical connection to an alternative source of electrical power.

10. Apparatus according to claim 9, wherein:

at least that portion of said skirt that is proximate to the face of said person is transparent.

11. Apparatus according to claim 10, further comprising:

a plurality of transparent panels releasably adhered in stacked alignment on the exterior of said skirt in opposition to the face of said person.

12. Apparatus according to claim 11, wherein:

said electrically powered fan includes an electric motor provided with an electrically unshielded commutator.

13. A respiration hood, comprising:

a generally hollow domed housing provided with an aspiration aperture communicating to the exterior thereof and a nested lower panel releasably engaged within the peripheral edge of said domed housing to form a cavity therebetween, said lower panel including an opening therein;

an air filter interchangeably deployed in said housing adjacent said aspiration aperture;

an electrically powered fan deployed within said cavity adjacent said opening in said panel for drawing ambient air across said filter, through said cavity and thereafter emitting same through said opening; and a flexible skirt releasably captured between said periphery of said panel and of said housing.

14. Apparatus according to claim 13, wherein:

said aspiration aperture includes a shouldered periphery conformed to engage the periphery of said filter and a removable cover provided with louvered apertures therein.

15. Apparatus according to claim 14, further comprising:

a battery mounted in said cavity and connected for selective electrical excitation of said electrically powered fan and electrical connection means deployed across said battery conformed for electrical connection to an alternative source of electrical power.

16. Apparatus according to claim 15, wherein:

said electrically powered fan includes an electric motor provided with an electrically unshielded commutator.

* * * * *